United States Patent [19]

Clark, Jr.

[11] 4,168,791

[45] Sep. 25, 1979

[54] FOLDING HANGER

[75] Inventor: Frank Clark, Jr., Girard, Pa.

[73] Assignee: Tantera, Inc., Girard, Pa.

[21] Appl. No.: 889,893

[22] Filed: Mar. 24, 1978

[51] Int. Cl.[2] ..... A47J 51/10

[52] U.S. Cl. ..... 223/94

[58] Field of Search ..... 223/85, 88, 89, 91, 223/92, 94; 211/113, 115, 116, 118

[56] References Cited

U.S. PATENT DOCUMENTS

| | | | |
|---|---|---|---|
| 2,489,492 | 11/1949 | Kleber | 223/88 X |
| 3,207,392 | 10/1965 | Ericson | 223/85 |
| 3,726,452 | 4/1973 | Jaffe | 223/91 |
| 3,860,154 | 1/1975 | Atkins | 223/88 |
| 4,074,838 | 2/1978 | Blasnik et al. | 223/85 |

FOREIGN PATENT DOCUMENTS

| | | | |
|---|---|---|---|
| 354526 | 8/1931 | United Kingdom | 223/94 |

*Primary Examiner*—George H. Krizmanich
*Attorney, Agent, or Firm*—Charles L. Lovercheck

[57] ABSTRACT

A garment hanger having a skirt bar with shoulder supports extending upwardly and toward each other from each end of the bar, terminating in the post and a hook with a spherical boss on it and the lower end of its stem interchangeably received in a recess in the post so that the hook can be swung from a folded position between the shoulder members and bar to a vertical U-position with the stem parallel to the post.

6 Claims, 6 Drawing Figures

FIG. 1.
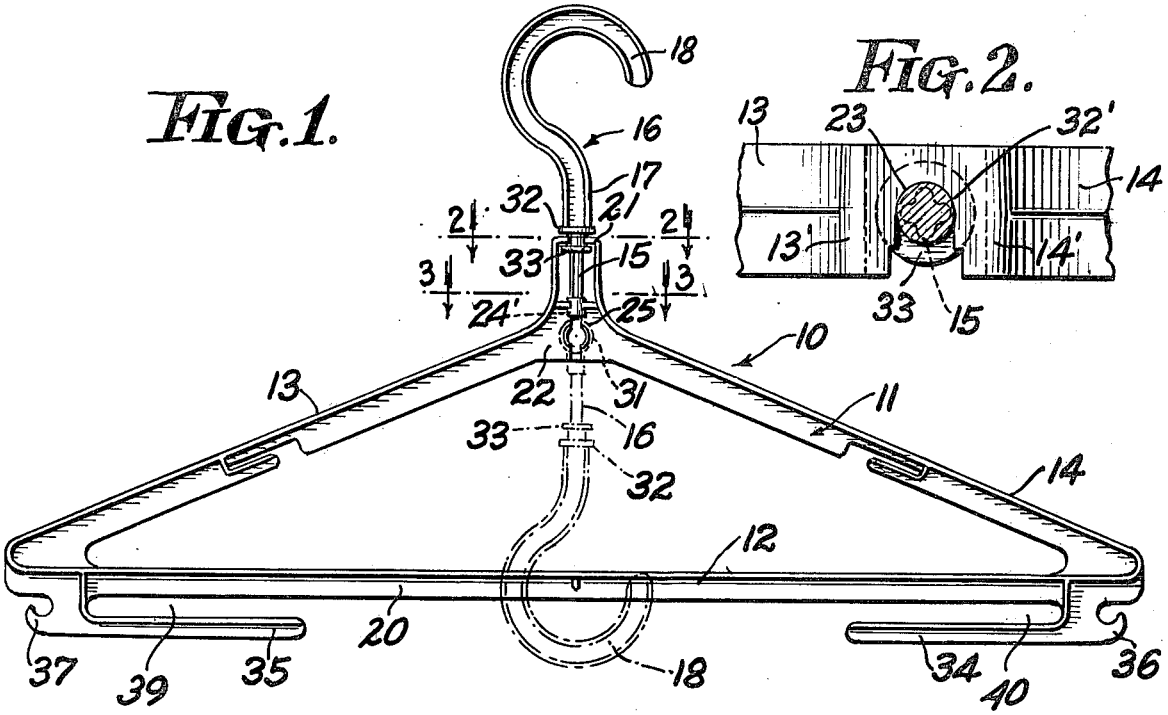
FIG. 2.
FIG. 3.
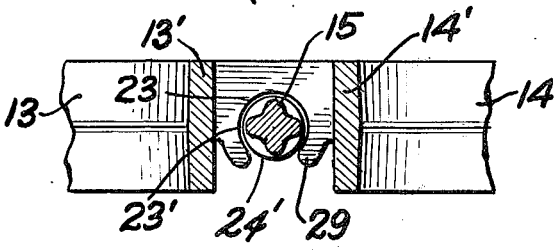
FIG. 4.
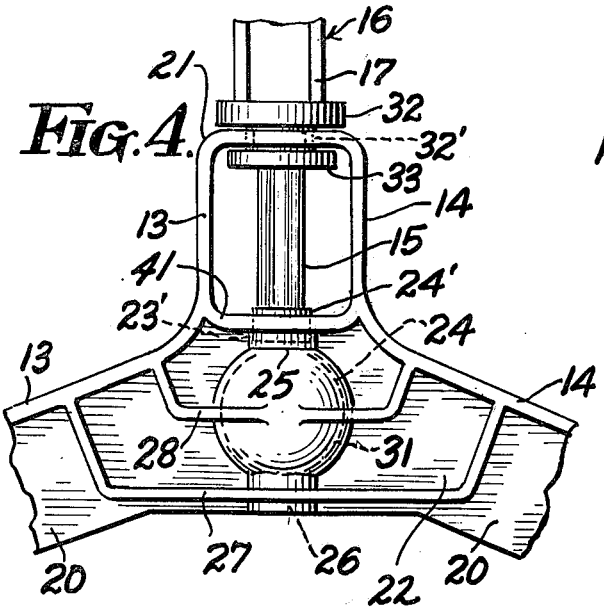
FIG. 5.
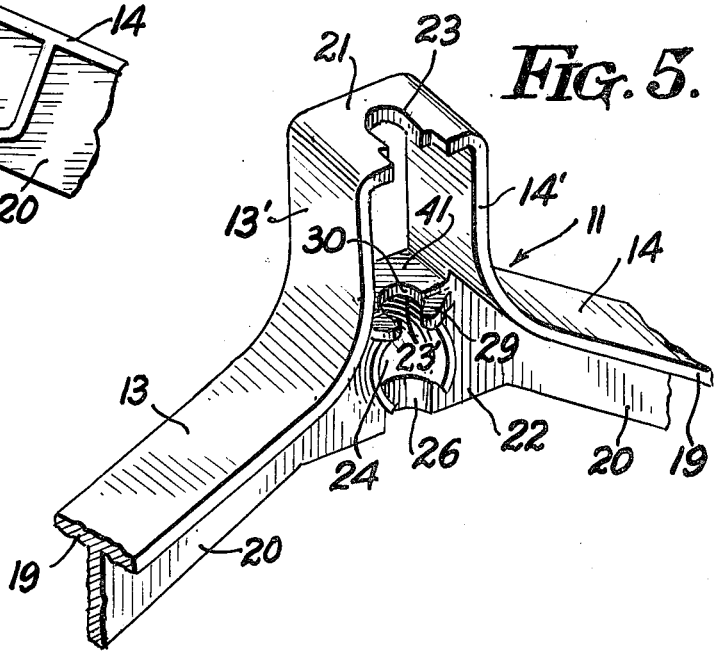
FIG. 6.
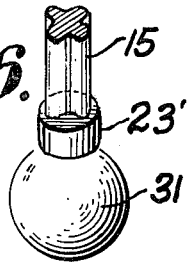

FOLDING HANGER

OBJECTS OF THE INVENTION

It is an object of the invention to provide an improved coat hanger.

Another object of the invention is to provide a coat hanger that is simple in construction, economical manufacture and simple and efficient to use.

Another object of the invention is to provide a coat hanger with a foldable hook.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

FIG. 1 is a side view of a hanger according to the invention showing the hook in unfolded position in full lines and in folded position in phantom lines.

FIG. 2 is an enlarged partial cross-section taken on line 2—2 of FIG. 1.

FIG. 3 is an enlarged partial cross-section taken on line 3—3 of FIG. 1.

FIG. 4 is an enlarged partial rear view of the hanger and folding mechanism.

FIG. 5 is an enlarged partial front view of the hanger with the hook member removed.

FIG. 6 is an enlarged, partial, cross-section of the ball and stem member which forms a part of the hook.

DETAILED DESCRIPTION OF THE DRAWINGS

Now, with more particular reference to the drawings, the garment hanger is indicated generally at 10. It has a hook member 16 and a hanger member 11. The hanger member 11 has a skirt support bar 12 and two shoulder supports 13 and 14 extending upwardly from the ends of the skirt support and terminating at a center post 15, said shoulder supports being generally T-shaped in cross-section having a flange 19 and a web 20. The flanges 19 terminate in spaced parallel plate-like sections 13' and 14' wich extend vertically and are connected together by the intermediate plate-like parts 21 and 41. The webs 20 terminate in the transverse web 22 at the upper end of the shoulder support portions.

A U-shaped recess 23 is formed in the plate-like part 21 and the side edges of the U-shaped recesses converge toward each other and outward whereby the hook cylindrical member 32' is snapped into place in the recess 23 as will later appear.

A socket 24 is formed on the transverse web part 22 and the socket has a recess 26 at the bottom and a recess 25 at its top to allow the stem 17 of the hook 16 to fold. The side of the web 22 opposite the recesses 25 and 26 has ribs 27 and 28 formed thereon to reinforce the socket 24. The flange 41 is integrally attached to the vertical plate-like members 13' and 14' and it extends generally parallel to the plate-like part 21. The plate-like member 41 has a recess 30 above the socket 24 for receiving the hook 16. Resilient fingers 29 are disposed one on each side of the opening of the recess 30. The fingers 29 will hold the hook 16 in place.

The hook 16 has a stem 17 and terminates at its upper end in a hook 18 and at its lower end in a spherical member 31 which is rotatably received in the socket 24. The recesses 25 and 26 in the socket 24 permit enough flexibility so that the spherical member 31 can be forced into the socket 24. The stem 17 has a post 15 disposed between cylindrical parts 24' and 32'.

Two spaced flanges 32 and 33 are fixed to the stem 17 between the spherical member and the hook 18 and the flanges 32 and 33 have the cylindrical part 32' between them which snaps into the recess 23. The cylindrical part 24' snaps into the recess 30. The collar 23' lies between the socket 24 and plate-like part 41.

The web 20 of the skirt support bar 12 has recesses 39 and 40 formed in it defining the hook 34 and 35 which may be used to support garments and hooks 36 and 37 are formed on the ends of the skirt support bar.

The foregoing specification sets forth the invention in its preferred, practical forms but the structure shown is capable of modification within a range of equivalents without departing from the invention which is to be understood is broadly novel as is commensurate with the appended claims.

The embodiment of the invention in which an exclusive property or privilege is claimed are defined as follows:

1. A hanger for a garment comprising a hanger body, said body (11) having a skirt support bar (12) and two upwardly and inwardly extending shoulder support (13 and 14) portions integrally connected at their lower ends to said skirt support bar extending upwardly and terminating at a post, said shoulder portions being generally T-shaped in cross-section having a downwardly extending web and a flange disposed generally perpendicular thereto, said flange extending upwardly along said shoulder portions and then curving upwardly and vertically, spaced from each other and generally parallel thereto then terminating in a horizontally extending plate-like web (21) portion, said horizontal plate-like web (21) portion having a U-shaped notch (23) therein, said web on each said shoulder portion extending toward the other and terminating in a bridging portion (22), said bridging portion (22) having a socket formed thereon at the center, said socket having a generally spherical inside surface and having spaced hooks defining a space and being opened at its front side to receive said spherical member, a hook member, said hook member having a hook at its upper end connected to a downwardly extending stem (15) and said stem terminating at its lower end in a spherical member adapted to snap into said socket, spaced flanges formed on said stem having a cylindrical member therebetween, said cylindrical member being adapted to snap into said U-shaped slot having edges that converge toward each other in said bridging portion, said hook being swingably attached to said hanger whereby said cylindrical member may be snapped out of said U-shaped slot and swung downwardly generally into a common plane with said shoulder support portions and said skirt bar.

2. The garment hanger recited in claim 1 wherein said socket has a recess in the lower side thereof said stem being received therein and held therein by snap action when said hook is swung downward.

3. The garment hanger recited in claim 2 wherein said socket has a second recess in the upper side diametrically opposite said recess in said lower side, said second recess in said upper side having said stem received therein and held by snap action.

4. The garment hanger recited in claim 1 wherein said stem has two axially spaced flanges thereon defining a space, said flanges receiving said plate-like web with said U-shaped slot when said hook is in unfolded position.

5. The garment hanger recited in claim 2 wherein said skirt bar has two spaced hooks formed thereon.

6. The garment hanger recited in claim 5 wherein said shoulder support bars each have a hook formed thereon.

* * * * *